US008913947B2

(12) United States Patent
Tonooka et al.

(10) Patent No.: US 8,913,947 B2
(45) Date of Patent: Dec. 16, 2014

(54) SHEET SUPPLY DEVICE AND MEDIUM PROCESSING DEVICE

(75) Inventors: Naoya Tonooka, Tokyo (JP); Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 533 days.

(21) Appl. No.: 13/253,175

(22) Filed: Oct. 5, 2011

(65) Prior Publication Data

US 2012/0087705 A1 Apr. 12, 2012

(30) Foreign Application Priority Data

Oct. 8, 2010 (JP) ..... 2010-228734

(51) Int. Cl.
*G03G 15/00* (2006.01)
*B65H 3/44* (2006.01)

(52) U.S. Cl.
CPC ..... *G03G 15/6508* (2013.01); *B65H 3/44* (2013.01); *B65H 2403/72* (2013.01); *B65H 2403/722* (2013.01); *B65H 2403/724* (2013.01); *B65H 2403/942* (2013.01); *B65H 2405/332* (2013.01); *B65H 2511/20* (2013.01); *B65H 2513/41* (2013.01); *B65H 2801/06* (2013.01)
USPC ..... 399/391; 399/388

(58) Field of Classification Search
USPC ..... 399/391
See application file for complete search history.

(56) References Cited

U.S. PATENT DOCUMENTS

| | | | | |
|---|---|---|---|---|
| 6,148,172 | A * | 11/2000 | Kanda et al. | 399/391 |
| 6,533,263 | B2 * | 3/2003 | Tamura | 271/10.01 |
| 7,587,166 | B2 * | 9/2009 | Aono | 399/401 |
| 8,672,315 | B2 * | 3/2014 | Goto | 271/9.01 |
| 2002/0096817 | A1 * | 7/2002 | Miki | 271/10.11 |
| 2008/0211176 | A1 * | 9/2008 | Miura et al. | 271/264 |

FOREIGN PATENT DOCUMENTS

| | | |
|---|---|---|
| JP | 05-201562 A | 8/1993 |
| JP | 08-143177 A | 6/1996 |
| JP | 2003-201045 A | 7/2003 |
| JP | A-2006-124058 | 5/2006 |

* cited by examiner

*Primary Examiner* — Anthony Nguyen
(74) *Attorney, Agent, or Firm* — Muncy, Geissler, Olds & Lowe, P.C.

(57) ABSTRACT

A sheet supply device that is addable to a medium processing device includes a storage part storing a medium and a controller. The controller performs a first operation in which the medium is supplied from the storage part of the sheet supply device, and a second operation in which another medium supplied from an upstream side of a medium path is carried to a downstream side. When the second operation is performed, the controller operates the carrying part by transmitting a drive force to the carrying part via the transmission mechanism without operating the carrying transmission member.

12 Claims, 13 Drawing Sheets

Fig. 7A Comparative Example

| | Main Body Only | With 1st Level Tray | With 2nd Level Tray | With 3rd Level Tray | With 4th Level Tray |
|---|---|---|---|---|---|
| Elc Consump. | 162.3W | 162.3W | 162.3W | 162.3W | 162.3W |
| Elc Consump. | | 16.8W | 10.4W | 10.4W | 10.4W |
| Elc Consump. | | | 16.8W | 10.4W | 10.4W |
| Elc Consump. | | | | 16.8W | 10.4W |
| Elc Consump. | | | | | 16.8W |
| Total | 162.3W | 179.1W | 189.5W | 199.9W | 210.3W |

Fig. 7B Embodiment

| | Main Body Only | With 1st Level Tray | With 2nd Level Tray | With 3rd Level Tray | With 4th Level Tray |
|---|---|---|---|---|---|
| Elc Consump. | 162.3W | 162.3W | 162.3W | 162.3W | 162.3W |
| Elc Consump. | | 16.8W | 7.5W | 7.5W | 7.5W |
| Elc Consump. | | | 16.8W | 7.5W | 7.5W |
| Elc Consump. | | | | 16.8W | 7.5W |
| Elc Consump. | | | | | 16.8W |
| Total | 162.3W | 179.1W | 186.6W | 194.1W | 201.6W |
| Effect | — | — | −1.5% | −3.0% | −4.3% |

SHEET SUPPLY DEVICE AND MEDIUM PROCESSING DEVICE

CROSS REFERENCE TO RELATED APPLICATION

The present application is related to, claims priority from and incorporates by reference Japanese patent application No. 2010-228734, filed on Oct. 10, 2010.

TECHNICAL FIELD

This application relates to a sheet supply device that supplies a medium to a medium processing device and a medium processing device including the sheet supply device.

BACKGROUND

As medium processing devices, there are image recording devices, such as printers, photocopy machines, facsimile machines, MFPs and the like, that include a function to print an image on a sheet. The term, "MFP" stands for a multi function peripheral, which is a printer with a facsimile function, a scanner function, a copy function and the like.

The image recording device generally includes therein a sheet cassette that stores media (hereinafter referred to as "sheets") on which an image is recorded. The sheet cassette is configured to be removable from the image recording device so as to facilitate supplementing of the sheets, switching to a different size of sheets and the like.

For the image recording device, it is preferable that the frequency of supplementing sheets, switching a different size of sheets and the like to the sheet cassette be reduced. Therefore, as a sheet supply device that supplies sheets to the image recording device, multi-level trays have been proposed that include sheet cassettes installed in multi-levels in the image recording device (see Japanese Laid-Open Patent Application No. 2006-124058).

Each tray includes a sheet cassette as a storage part that stores sheets, a sheet supply roller as a sheet supply part that supplies sheets from the sheet cassette, a carrying roller as a carrying part that carries the sheets to subsequent parts, a carrying motor as a drive source that drives the sheet supply roller and the carrying roller, a sheet supply clutch as a sheet supply transmission member that selectively transmits a drive force to the sheet supply roller, a carrying clutch as a carrying transmission member that selectively transmits the drive force to the carrying roller, and a controller that selectively operates each of the motor and clutches.

By receiving electricity from the image recording device to drive the carrying motor, each tray selectively performs one of a sheet supply operation (hereinafter referred to as a "first operation") in which the sheets stored in the sheet cassette are separated and in which each sheet is supplied to subsequent mechanisms, and a carrying operation (hereinafter referred to as a "second operation") in which a sheet supplied from another tray is carried to the subsequent parts.

As explained below, the conventional sheet supply devices (multi-level trays) have a problem that entire electricity consumption by the image recording device and all sheet supply devices (multi-level trays) (hereinafter referred to simply as "entire electricity consumption") increases when there is a sheet supply device that performs only the second operation (carrying operation of sheets supplied from another tray) in a state where a plurality of sheet supply devices are installed in the image recording device.

For instance, when multi-level trays with four or more levels are installed, and when a sheet is supplied from the fourth level tray, a sheet supply command is output to the fourth level tray, and a carrying command is output to the first to third level trays. In response, the fourth level tray separates the sheets stored in the sheet cassette piece by piece and feeds each sheet to the subsequent parts (here, the first to third level trays and the image recording device), and the first to third level trays carry the sheet to the subsequent mechanisms.

At this time, the image recording device supplies electricity for supplying and carrying the sheet (i.e., electricity for operating the carrying motor, sheet supply clutch and carrying clutch) to the fourth level tray, and electricity for carrying the sheet (i.e., electricity to operate the carrying motor and carrying clutch) to the first to third level trays.

Therefore, the image recording device needs to supply electricity for operating the carrying clutch to all of the trays, when a plurality of sheet supply devices are installed in the image recording device and when there are sheet supply devices that perform only the second operation. Therefore, the multi-level trays increase the entire electricity consumption.

In addition, the image recording device needs to use a large capacity power source unit to supply electricity for operating the carrying clutch to all sheet supply devices (here, multi-level trays). Therefore, for the conventional sheet supply devices (multi-level trays), it is necessary to increase the size of the power source unit provided in the image recording device. As a result, the conventional sheet supply devices (multi-level trays) have a problem that miniaturization of the image recording device and lowering cost are prevented.

Therefore, the inventors has considered that, when a plurality of sheet supply devices (multi-level trays) are installed in the image recording device, and when there is a sheet supply device that performs only the second operation (operation to carry a medium supplied from another sheet supply device to subsequent mechanisms), the entire electricity consumption is decreased when the sheet supply device that performs only the second operation rotates the carrying roller without receiving a supply of electricity for carrying the sheet (i.e., without operating the carrying clutch).

The present application is provided to solve the above-described problems and has a principle object to provide a supply device that reduces electricity consumption when a medium supplied from another sheet supply device is carried to subsequent mechanisms.

SUMMARY

In order to realize the problem, a sheet supply device disclosed in the application that is addable to a medium processing device and that is configured to suppy media to the medium processing device, the sheet supply device includes: a storage part that stores a first medium; a sheet supply part that supplies the first medium from the storage part; a sheet carrying path through which a second medium is carried from a upstream side of a medium path; a carrying part that carries the first medium and second medium to a downstream side of the medium path; a drive source that provides a drive force to each of the sheet supply part and the earring part; a carrying transmission member that selectively transmits the drive force to the carrying part; a transmission mechanism that transmits the drive force to the carrying part without transmitting the drive force via the carrying transmission member; and a controller that operates the drive source and the carrying transmission member, wherein the controller performs a first operation in which the first medium is supplied from the storage part of the sheet supply device, and a second operation in which the second medium supplied from the upstream side is carried to the downstream side, when the second operation is performed, the controller operates the carrying part by transmitting the drive force to the carrying part via the transmission mechanism without operating the carrying transmission member.

In another view, a medium processing device disclosed in the application includes: an image forming unit that forms an image with developer; a fusion unit that fuse the image by the image forming unit; two sheet supply devices that are arranged on the upstream side from the image forming unit, one being a first sheet supply device on the upstream side and the other being a second sheet supply device on the downstream side, each of the first and second sheet supply devices having an inlet and outlet; and a sheet carrying path through which the first and second media are carried to the image forming unit. Wherein the outlet of the first sheet supply device is connected to the inlet of the second sheet supply device so that the second medium supplied from the first sheet supply device is carried to the image forming unit through the second sheet supply device.

This sheet supply device transmits a drive force to the carrying part via a transmission mechanism without operating the carrying transmission member during the second operation (i.e., during an operation to carry the second medium supplied from another sheet supply device to a subsequent mechanism). Therefore, the sheet supply device reduces electricity consumption for operating the carrying transmission member during the second operation.

According to this application, a supply device and a medium processing device that reduce electricity consumption for carrying the second medium supplied from other sheet supply devices is carried to subsequent mechanisms are provided.

BRIEF DESCRIPTION OF THE DRAWINGS

FIGS. 7A and 7B are a second comparative diagram of electricity consumption of the comparative example and electricity consumption of the first embodiment.

DETAILED DESCRIPTION OF EMBODIMENTS

Figure 1:
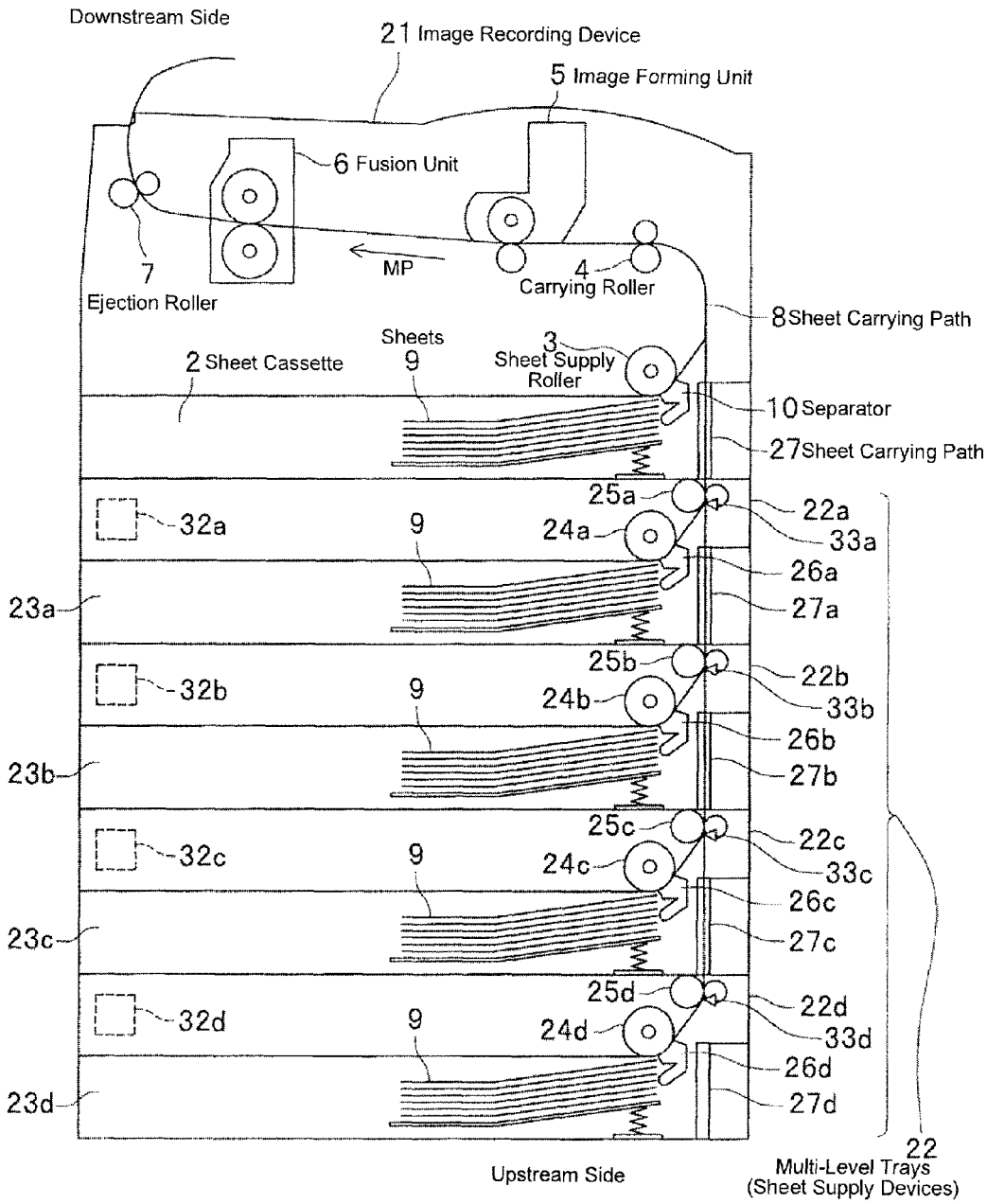
FIG. 1 is a first schematic diagram illustrating a configuration of sheet supply devices according to a first embodiment.

Embodiments of the present application (hereinafter referred to as "embodiment(s)") are described below in detail with reference to the drawings. Each drawing merely schematically illustrates the embodiments to allow sufficient understanding of the embodiments. Therefore, the embodiments are not limited to the examples shown in the drawings. In addition, in each drawing, common and similar components are marked with the same symbols, and duplicative explanations are omitted.

First Embodiment

Configuration of Sheet Supply Device

Figure 2:
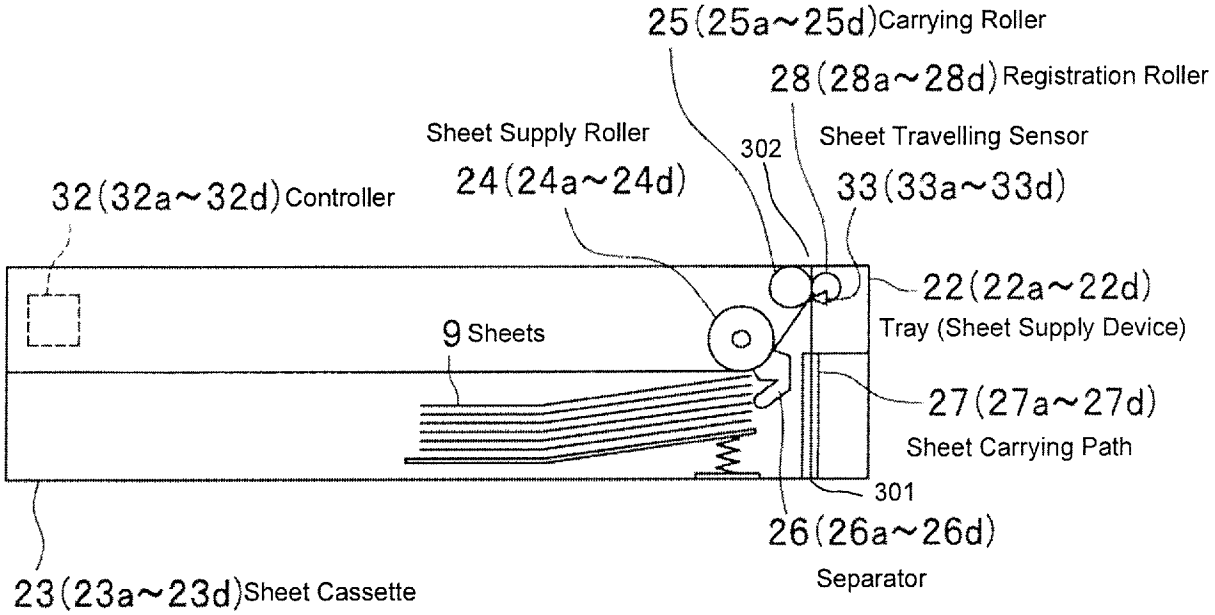
FIG. 2 is a second schematic diagram illustrating the configuration of a sheet supply device according to the first embodiment.

A configuration of a sheet supply device according to a first embodiment is explained below with reference to FIGS. 1 and 2. Each of FIGS. 1 and 2 is a schematic diagram illustrating the configuration of the sheet supply device according to the first embodiment. FIG. 1 illustrates a cross-section of multi-level trays 22 as the sheet supply devices according to the embodiment that are installed in an image recording device 21. FIG. 2 is illustrates an internal configuration of a tray 22.

(Configuration of Image Recording Device)

A configuration of the image recording device 21 in which the multi-level trays 22 are installed is first explained below. As shown in FIG. 1, the image recording device 21 (hereinafter, referred to as "main body") includes a sheet cassette 2 (or main sheet cassette), a sheet supply roller 3, a carrying roller 4, an image forming unit 5, a fusion unit 6, an ejection roller 7, a sheet carrying path 8 and a separator 10. In the embodiment, the sheet cassette 2 is a part of equipment of the main body (or the image recording device 21), being detachable to the main body. When installed, the sheet cassette 2 is firmly mounted on the main body. The image forming unit 5 functions to form an image with developer such as toner or ink. The fusion unit functions to fuse the image by the image forming unit on the sheet.

The sheet cassette 2 is a component that stores sheets 9. In the sheet cassette 2, a sheet carrying path 27 is formed through which the sheets 9 supplied from the multi-level trays 22 passes. The sheet supply roller 3 is a component that feeds the sheets 9 stored in the sheet cassette 2 piece by piece to subsequent mechanisms. The carrying roller 4 is a component that carries each sheet 9. The image forming unit 5 is a component that forms an image to be transferred onto the sheet 9. The fusion unit 6 is a component that fixes the image transferred onto the sheet 9 to the sheet 9. The ejection roller 7 is a component that ejects the sheet 9 onto which the image has been fixed. The sheet carrying path 8 is a path through which the sheet 9 is carried. The separator 10 is a component that separates the sheets 9 into each piece by applying loads by pinching the sheet 9 with the sheet supply roller 3.

(Configuration of Sheet Supply Device)

Next, the multi-level trays 22 are explained. An arbitrary number of multi-level trays 22 that meet the user's needs may be installed in the image recording device 21. As a result, the image recording device 21 may handle a large number of sheets 9 and different sizes of sheets 9 at the same time. Therefore, with the image recording device 21 in which the multi-level trays 22 are installed, the frequency for supplementing the sheets 9, or switching the sheets 9 with different sizes, and the like in a sheet cassette 23 (or tray sheet cassette) is reduced. The tray sheet cassette 23 is detachable to the main body.

For instance, in the embodiment shown in FIG. 1, four trays 22 are installed in the image recording device 21 in the up-down direction. That is, in the embodiment shown in FIG. 1, in order from the top to the bottom, a first level tray 22*a* is installed below the image recording device 21; a second level tray 22*b* is installed below the first level tray 22*a*; a third level tray 22*c* is installed below the second level tray 22*b*; and a fourth level tray 22*d* is installed below the third level tray 22*c*. Moreover, additional trays may be installed subsequently below the fourth level tray 22*d*.

In FIG. 1, the sheet is carried upward from the tray 22*d*. When an entire path of the sheet in the image recoding device is defined as a medium path, the bottom of FIG. 1 is on the upstream side of the medium path. The top is on the downstream side. The direction of the medium path is indicated with an arrow MP.

Each tray 22 includes the later-discussed carrying motor 31 (see FIG. 3) and controller 32 (see FIG. 2). By receiving a supply of electricity from the image recording device 21 to drive the carrying motor 31, each tray 22 selectively performs one of a sheet supply operation (hereinafter referred to as a "first operation") that separates the sheets 9 stored in the sheet cassette 23 piece by piece and feeds each sheet 9 to the subsequent mechanisms, and a carrying operation (hereinafter referred to as a "second operation") that carries a sheet 9 supplied from another tray to the subsequent parts.

In the application, a medium that is supplied by the first operation is defined as a first medium. Another medium that is supplied by the second operation is as a second medium. Specifically, the second medium is supplied from an external device, for example another tray through the sheet carrying path therein. In the embodiment illustrated in FIG. 1, when a sheet stacked in the sheet cassette 23*b* is carried with the supply roller 24*b* that is arranged in the same tray as the sheet cassette 23*b* is, the sheet 9 is defined the first sheet. On the other hand, a sheet stacked in sheet cassette 23*c*, which is arranged therebelow, is defined the second sheet when the sheet is carried through the sheet carrying path 27*b*.

Each tray 22 includes the same configuration. Below, when a component of each tray 22 is distinguished from others, alphabets "a," "b," "c" and "d" are added, in order from the top level to the bottom level, at the end of each symbol to indicate the component.

As shown in FIGS. 1 and 2, each of the trayes 22 includes the sheet cassette 23, a sheet supply roller 24, a carrying roller 25, a separator 26, a registration roller 28, the controller 32, a sheet traveling sensor 33 and a sheet carrying path 27. Further, the tray 22 has an inlet 301 on the bottom and outlet 302 on the top. From the inlet 301, a sheet is carried to the sheet carrying path 27, the sheet coming from a sheet supply device that is disposed on an upstream side of the medium path. The sheet is carried through the carrying roller 25 and registration roller 28, then is ejected off the outlet 302. The ejected sheet is then supplied to another sheet carrying path of another sheet supply device that is disposed on a downstream side of the medium path. In order to carry one sheet through multiple sheet supply devices, an outlet of a sheet supply device is arranged to be connected to an inlet of another sheet supply device that is disposed on the downstream side.

Considering only two of the tray 22*a* to 22*d*, one on the upstream side may be regarded as a first tray (first sheet supply device), the other on the downstream side may be as a second tray (second sheet supply device).

Similar to the sheet cassette 2 of the main body, the sheet cassette 23 is a component that stores sheets 9. The sheet cassette 23 is configured to be freely removable from the multi-level trays 22 so that the sheets 9 can be easily supplemented, switched to a different size, and the like. In the sheet cassette 23, a sheet carrying path 27 is formed through which the sheet 9 supplied from other trays passes.

Similar to the sheet supply roller 3 (or main sheet supply roller) of the main body, the sheet supply roller 24 (or tray sheet supply roller) is a component that feeds the sheets 9 stored in the sheet cassette 2 piece by piece to subsequent mechanisms that is disposed on the downstream side of the medium path. The carrying roller 25 is a component that carries the sheets 9 to the subsequent mechanisms. Similar to the separator 10 (or main separator) of the main body, the separator 26 (or tray separator) is a component that separates the sheets 9 into each piece by applying loads by pinching the sheet 9 with the sheet supply roller 24. The registration roller 28 is a component that aligns the travelling sheets 9 by applying loads by pinching the sheet 9 with the carrying roller 25. The controller 32 is a component that controls operation of each part of the multi-level trays 22. The sheet travelling sensor 33 is a component that detects a travelling position of the sheet 9.

The tray 22 selectively performs one of the first operation (sheet supply operation) and the second operation (carrying operation for the second sheet 9, which is a second medium, supplied from other trays) as discussed above. For example, in the multi-level trays 22*a*-22*d*, when the third level tray 22*c* supplies a sheet 9, the third level tray 22*c* separates the sheets 9 stored in the sheet cassette 23*c* piece by piece using the sheet supply roller 24*c* and the separator 26*c* and feeds each sheet 9 to the second level tray 22*b* using the carrying roller 25*c*. The sheet 9 passes the sheet carrying path 27*b* formed in the second level tray 22*b*. When the sheet 9 is detected by the sheet traveling sensor 33*b*, the second level tray 22*b* carries the sheet 9 to the first level tray 22*a* using the carrying roller 25*b*. The sheet 9 passes through the sheet carrying path 27*a* formed in the first level tray 22*a*. When the sheet 9 is detected by the sheet traveling sensor 33*a*, the first level tray 22*a* carries the sheet 9 to the image recording device 21 using the carrying roller 25*a*. As a result, the sheet 9 is carried to the sheet carrying path 8 formed in the image recording device 21. To realize these operations, the multi-level trays 22 include a mechanism shown in FIGS. 3A, 3B and 4 as a drive mechanism that drives the sheet supply roller 24 and the carrying roller 25.

Here, to explain characteristics of the configuration of the drive mechanism for the multi-level trays 22 in the first embodiment, a configuration of a drive mechanism for multi-level trays 1022 is described as a comparative example. Then, the configuration of the drive mechanism for the multi-level trays 22 in the first embodiment is described. Similar to the conventional sheet supply devices, the multilevel trays 1022 as the comparative example are sheet supply devices with a configuration in which electricity for operating the later-described carrying electromagnetic clutch is supplied to all of the multi-level trays 1022 when there are multi-level trays 1022 that perform only the second operation while a plurality of the multi-level trays 1022 are installed in the image recording device 21.

(Configuration of Drive Mechanism for Sheet Supply Device as Comparative Example)

Figure 11:
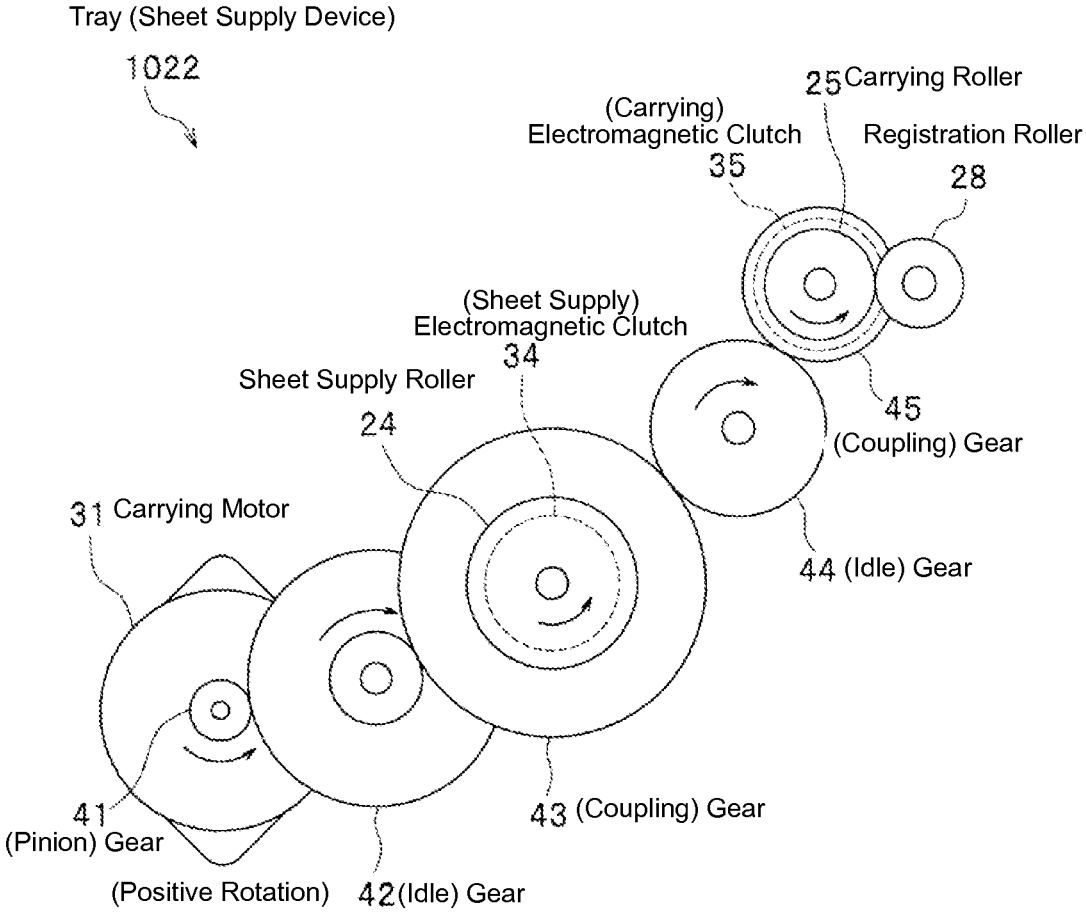
Fig. 11 Prior Art
FIG. 11 is a first schematic diagram illustrating a configuration of a drive mechanism for a sheet supply device as a comparative example.
Figure 12:
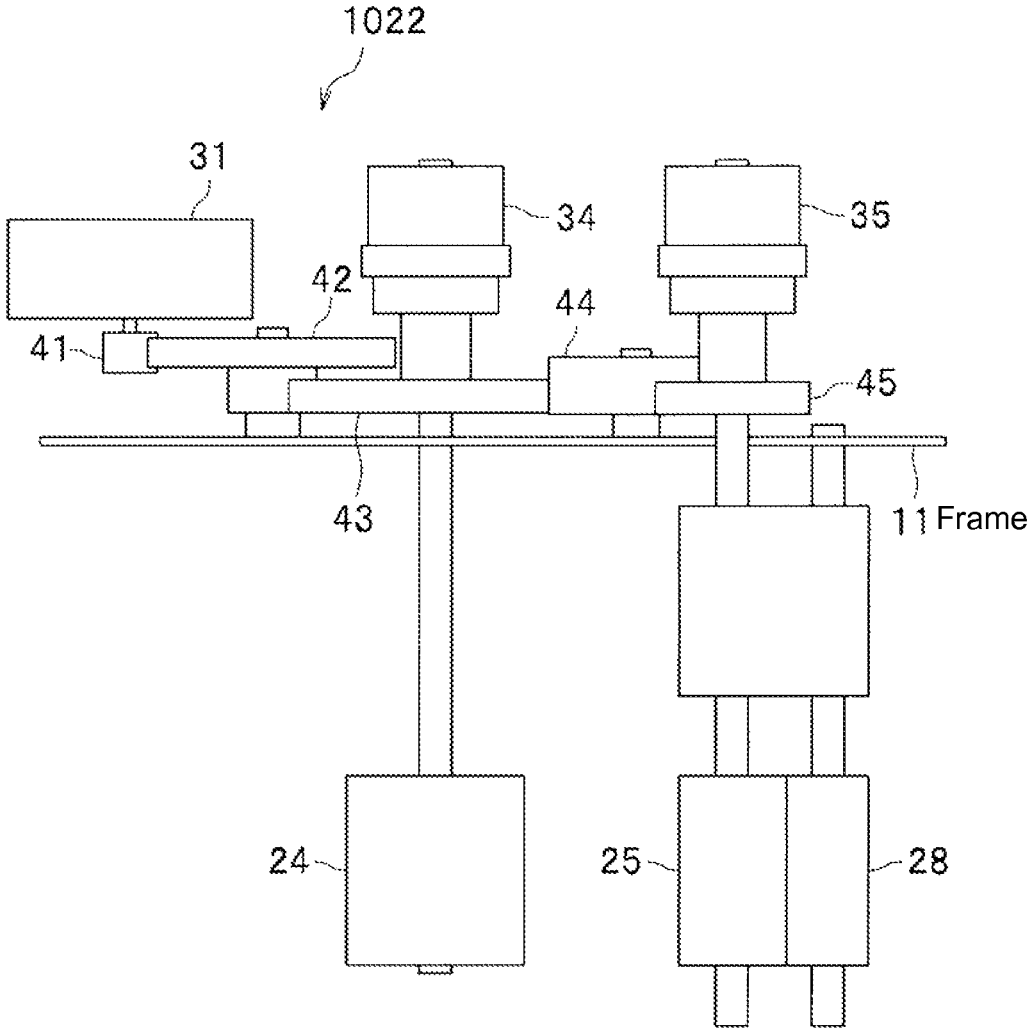
Fig. 12 Prior Art
FIG. 12 is a second schematic diagram illustrating the configuration of the drive mechanism for the sheet supply device as the comparative example.

The configuration of the drive mechanism for the multi-level trays 1022 as the comparative example is explained below with reference to FIGS. 11 and 12. Each of FIGS. 11 and 12 is a schematic diagram illustrating the configuration of the drive mechanism for the sheet supply device as the comparative example. FIG. 11 is a side view of the configuration of the drive mechanism for the multi-level trays 1022, and FIG. 12 is a top view of the configuration of the drive mechanism for the sheet supply device.

As shown in FIGS. 11 and 12, a tray 1022 includes a gear array that is configured from the carrying motor 31, electromagnetic clutches 34 and 35 and gears 41 to 45, as a drive mechanism that drives the sheet supply roller 24 and the carrying roller 25.

The carrying motor 31 is a drive means that is operated and rotated by receiving a supply of electricity from the image recording device 21 in accordance with a control by the controller 32. The carrying motor 31 is fixed to a frame 11 (see FIG. 12) and transmits a drive force to the gears 42 to 45 via the gear 41 that is press-fit in the rotational shaft of the carrying motor 31. The electromagnetic clutch 34 is a connection means that connects the gear 43 and the sheet supply roller 24 by receiving a supply of electricity from the image recording device 21 and operating in accordance with a control by the controller 32. The electromagnetic clutch 34 is arranged coaxially with the sheet supply roller 24 via a support shaft. The electromagnetic clutch 35 is a connection means that connects the gear 45 and the carrying roller 25 by receiving a supply of electricity from the image recording device 21 and operating in accordance with a control by the controller 32. The electromagnetic clutch 35 is arranged coaxially with the carrying roller 25 via a support shaft. Below, when the electromagnetic clutch 34 and the electromagnetic clutch 35 are distinguished from each other, the electromagnetic clutch 34 is called a "sheet supply electromagnetic clutch 34," and the electromagnetic clutch 35 is called a "carrying electromagnetic clutch 35."

The gear 41 is configured as a pinion gear attached to the rotational shaft of the carrying motor 31. The pinion gear 41 rotates in accordance with the rotation of the carrying motor. The gear 42 is configured as an idle gear that engages with the pinion gear 41. The idle gear 42 is attached freely rotatably to a stud that is fixed to the frame 11 (see FIG. 12) by caulking or the like. The idle gear 42 rotates in accordance with the rotation of the pinion gear 41 and functions as a deceleration gear. The gear 43 is configured as a coupling gear that engages with the idle gear 42. The coupling gear 43 is attached freely rotatably to a support shaft that supports the sheet supply roller 24 and the sheet supply electromagnetic clutch 34. As electricity is supplied to the sheet supply electromagnetic clutch 34, the coupling gear 43 transmits a drive force from the carrying motor 31 to the sheet supply roller 24 via the sheet supply electromagnetic clutch 34 and rotates the sheet supply roller 24. The gear 44 is configured as an idle gear that engages with the coupling gear 43. The idle gear 44 is attached freely rotatably to a stud that is fixed to the frame 11 by caulking or the like. The idle gear 44 rotates in accordance with the rotation of the coupling gear 43. The gear 45 is configured as a coupling gear that engages with the idle gear 44. The coupling gear 45 is attached freely rotatably to a support shaft that supports the carrying roller 25 and the carrying electromagnetic clutch 35. As electricity is supplied to the carrying electromagnetic clutch 35, the coupling gear 45 transmits a drive force to the carrying roller 25 via the carrying electromagnetic clutch 35 and rotates the carrying roller 25.

When electricity is supplied to the sheet supply electromagnetic clutch 34, the tray 1022 transmits a drive force from the carrying motor 31 to the sheet supply roller 24 via the gears 41 to 43 and rotates the sheet supply roller 24. In addition, when electricity is supplied to the carrying electromagnetic clutch 35, the tray 1022 transmits a drive force from the carrying motor 31 to the carrying roller 25 via the gears 41 to 45 and rotates the carrying roller 25. In the example shown in FIG. 11, the carrying motor 31 rotates in a positive rotational direction when the carrying motor 31 rotates counterclockwise. The tray 1022 performs the sheet supply operation using the sheet supply roller 24 and the carrying operation using the carrying roller 25 when the carrying motor 31 rotates in the positive rotational direction.

(Configuration of Drive Mechanism for Sheet Supply Device According to First Embodiment)

Figure 3A:
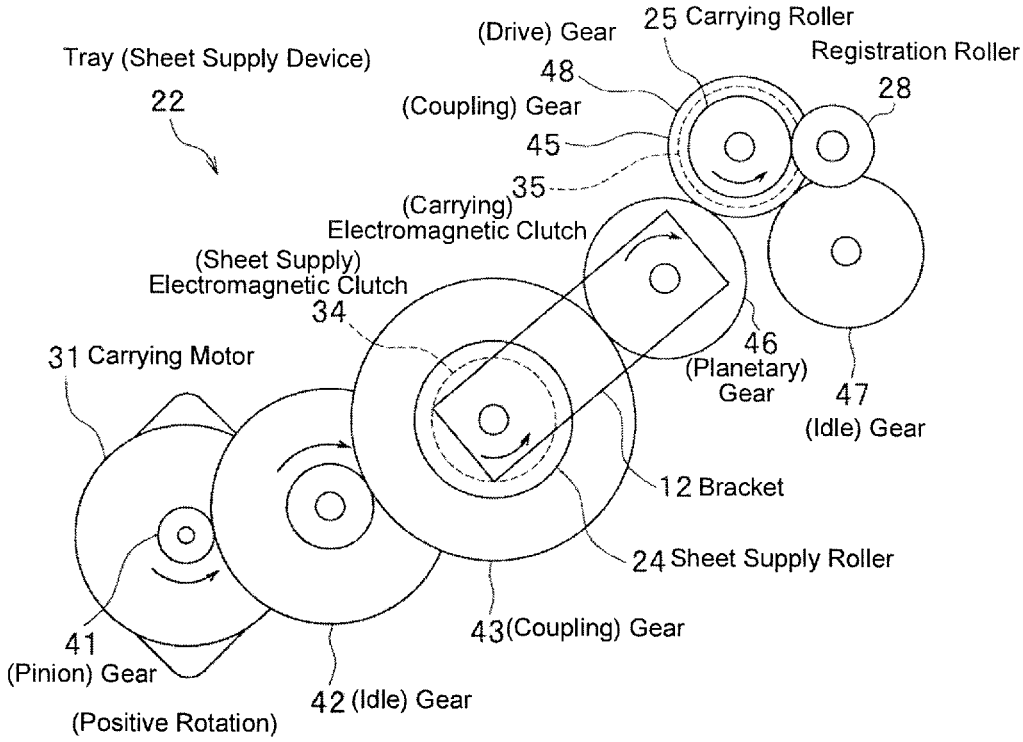
FIGS. 3A and 3B are first schematic diagrams illustrating a configuration of a drive mechanism for the sheet supply device according to the first embodiment.
Figure 3B:
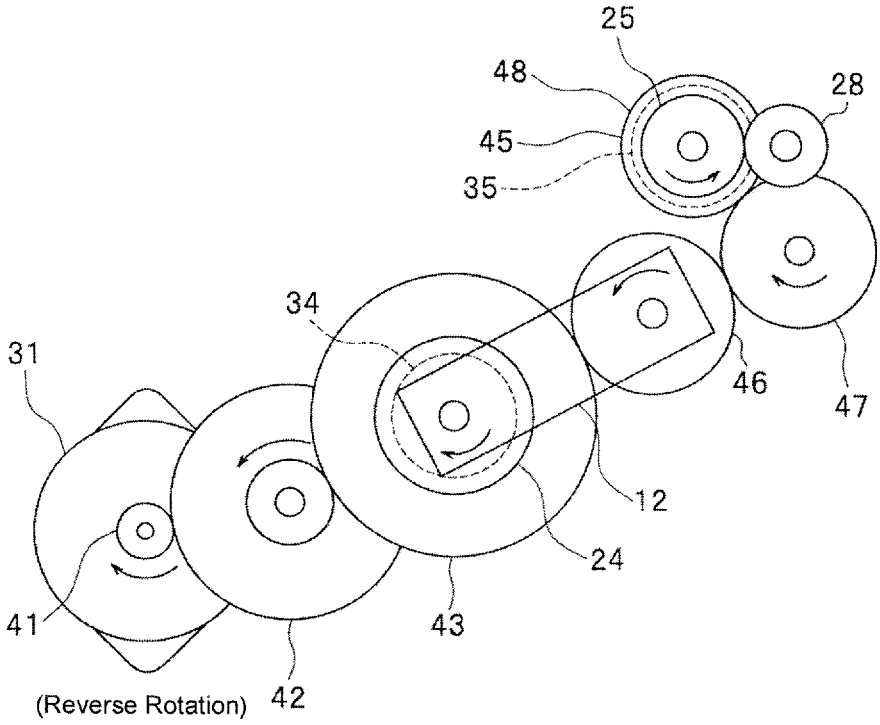
Figure 4:
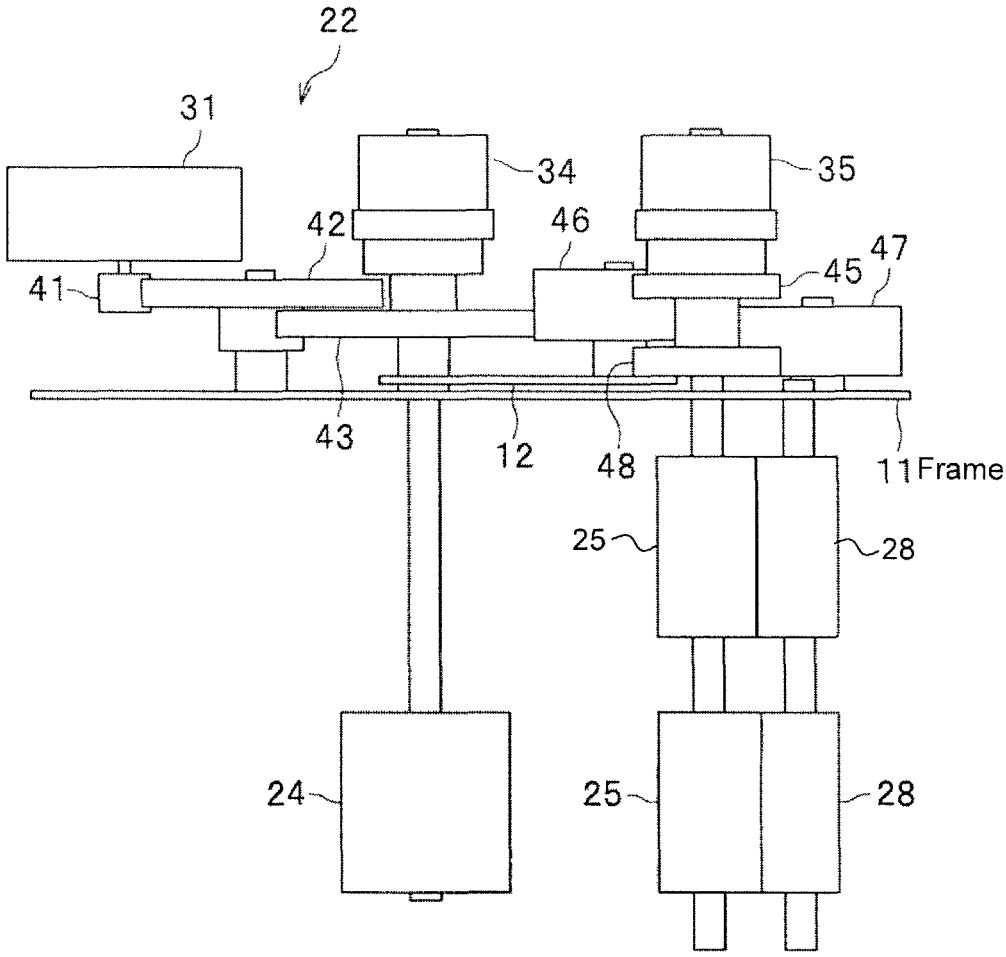
FIG. 4 is a second schematic diagram illustrating the configuration of the drive mechanism for the sheet supply device according to the first embodiment.

A configuration of a sheet supply device according to a first embodiment is explained below with reference to FIGS. 3A, 3B and 4. Each of FIGS. 3A, 3B and 4 is a schematic diagram illustrating the configuration of the drive mechanism for the sheet supply device according to the first embodiment. FIGS. 3A and 3B are side views of the configuration of the drive mechanism for the tray 22 as the sheet supply device according to the first embodiment. FIG. 3A illustrates a state of the drive mechanism for the tray 22 when the first operation (sheet supply operation) is performed, and FIG. 3B illustrates a state of the drive mechanism for the tray 22 when the second operation (carrying operation of a sheet 9 supplied from another tray) is performed. FIG. 4 is a top view of the configuration of the drive mechanism for the tray 22.

Compared with the sheet supply device (tray 1022) as the comparative example, the tray 22 has a configuration in which the idle gear 44 (see FIGS. 11 and 12) as the drive mechanism for rotating the carrying roller 25 in the second operation is removed, and instead, a bracket 12, a planetary gear 46, an idle gear 47 and a drive gear 48 are included.

The bracket 12 is a component that supports the planetary gear 46 such that the planetary gear rotates around the coupling gear 43. The bracket 12 is attached freely rotatably to a boss of the coupling gear 43 so that the planetary gear 46 rotates around the coupling gear 43 in the same direction as the coupling gear 43. Moreover, the bracket is provided with a limiter (not shown) so that the bracket 12 rotates by certain angles.

The planetary gear 46 is a gear that engages with the coupling gear 43. The planetary gear 46 is attached freely rotatably to a stud that is fixed to the bracket 12 by caulking or the like. As the bracket 12 rotates by certain angles, the planetary gear 46 rotates around the coupling gear 43 and is positioned selectively at one of the positions illustrated in FIGS. 3A and 3B. As a result, the planetary gear 46 selectively engages with one of the coupling gear 45 and the idle gear 47. The planetary gear 46 transmits the drive force from the carrying motor 31 via the coupling gear 43 to either the coupling gear 45 or the idle gear 47 that engages with the planetary gear 46.

The idle gear 47 is a gear that engages with the planetary gear 46 and the drive gear 48. The idle gear 47 is attached freely rotatably to a stud as a supporting point that is fixed to the frame 11 by caulking or the like. When the idle gear 47 is engaged with the planetary gear 46, the idle gear 47 rotates in accordance with the rotation of the planetary gear 46 and functions as a deceleration gear.

The drive gear 48 is a gear that engages with the idle gear 47. The drive gear 48 is mounted to a support shaft that supports the carrying roller 25 and the carrying electromagnetic clutch 35 such that the driving force is conveyed to the support shaft. The drive gear 48 rotates in accordance with the rotation of the idle gear 47.

When the tray 22 rotates the carrying roller 25 in the first operation (sheet supply operation), the tray 22 positions the planetary gear 46 at a position to engage with the coupling gear 45 and rotates the carrying motor 31 in the positive rotational direction (counterclockwise direction shown in FIG. 3A). As a result, the drive force from the carrying motor 31 is transmitted to the carrying roller 25 via the gears 41 to 43, the planetary gear 46, the coupling gear 45 and the carrying electromagnetic clutch 35, and thereby the carrying roller 25 is rotated.

In contrast, as shown in FIG. 3B, when the tray 22 rotates the carrying roller 25 in the second operation (carrying operation of the sheet 9 supplied from another tray), the tray 22 positions the planetary gear 46 at a position to engage with the idle gear 47 and rotates the carrying motor 31 in a rotational direction opposite from the rotation shown in FIG. 1 (clockwise direction shown in FIG. 3B). As a result, the drive force from the carrying motor 31 is transmitted to the carrying roller 25 via the gears 41 to 43, the planetary gear 46, the idle gear 47 and the drive gear 48, and thereby the carrying roller 25 is rotated.

Therefore, by selectively switching the position of the planetary gear 46 the rotational direction of the carrying motor 31, the tray 22 switches a transmitting route for the drive force between the carrying motor 31 and the carrying roller 25.

<Operation of Sheet Supply Device>

Here, to explain characteristics of the operation of the drive mechanism for the multi-level trays 22 in the first embodiment, an operation of the drive mechanism for the tray 1022 is described as a comparative example. Then, the operation of the drive mechanism for the tray 22 in the first embodiment is described.

(Operation of Sheet Supply Device as Comparative Example)

Figure 13A:
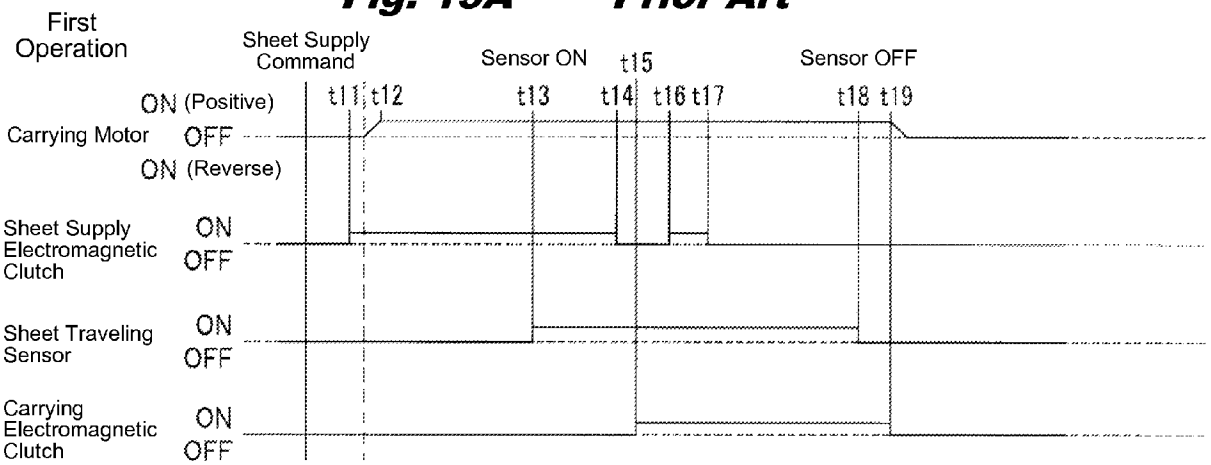
Fig. 13A Prior Art
FIGS. 13A and 13B are time charts illustrating operations of the sheet supply device as the comparative example.
Figure 13B:
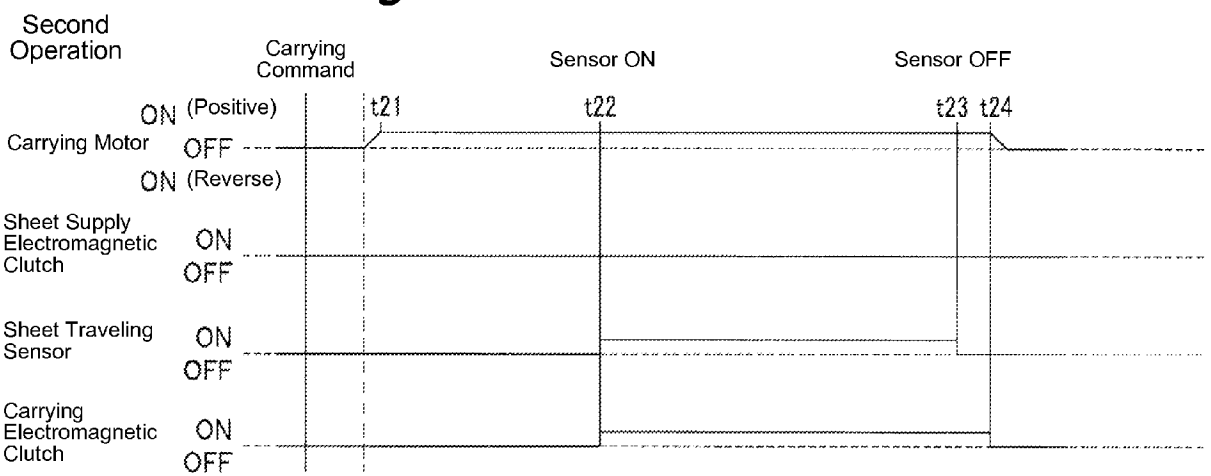
Fig. 13B Prior Art

The operation of the tray 1022 is explained below with reference to FIGS. 11, 13A and 13B. FIGS. 13A and 13B are time charts illustrating operations of the sheet supply device as the comparative example.

(First Operation, or Sheet Supply Operation)

First, the first operation (sheet supply operation) of the tray 1022 is explained.

When the controller 32 of the tray 1022 receives a sheet supply command from the image recording device 21, the controller 32 starts the supply of electricity to the sheet supply electromagnetic clutch 34 (t11) and turns in a state to rotate the sheet supply roller 24 in accordance with the rotation of the coupling gear 43. As a result, the tray 1022 turns in a state to transmit a drive force from the carrying motor 31 to the sheet supply roller 24. After that, the controller 32 rotates the carrying motor 31 in the positive rotational direction (counterclockwise direction shown in FIG. 11) at a predetermined rotational speed (t12). As a result, the tray 1022 transmits a drive force from the carrying motor 31 to the sheet supply roller 24 via the gears 41 to 43 and rotates the sheet supply roller 24. Thereby, the tray 1022 starts the sheet supply operation (i.e., operation to feed the sheets 9 stored in the internal sheet cassette 23 piece by piece to subsequent mechanisms).

The sheet 9 supplied from the internal sheet cassette 23 is guided to the carrying roller 25 through the carrying path formed by the sheet guide (not shown).

When a front end of the sheet 9 is detected by the sheet traveling sensor 33 (t13), the controller 32 calculates a set amount in which a predetermined amount is added to a movement amount of the front end of the sheet 9 to reach the carrying roller 25, and temporality stops the supply of electricity to the sheet supply electromagnetic clutch 34 after carrying the sheet 9 by the set amount (t14). As a result, the tray 1022 stops the carrying of the sheet 9 and aligns the sheet 9 by pressing the front end of the sheet 9 against the carrying roller 25.

After a predetermined length of time, the controller 32 starts the supply of electricity to the carrying electromagnetic clutch (t15) and turns in a state to rotate the carrying roller 25 in accordance with the rotation of the coupling gear 45. As a result, the tray 1022 turns in a state to transmit the drive force from the carrying motor 31 to the carrying roller 25. Thereby, the carrying roller 25 rotates.

Next, the controller 32 resumes the supply of electricity to the sheet supply electromagnetic clutch 34. As a result, the sheet 9 advances between the carrying roller 25 and the registration roller 28. Thereby, the tray 1022 carries the sheet 9 to the subsequent mechanisms using the carrying roller 25.

The controller 32 stops the supply of electricity to the sheet supply electromagnetic clutch 34 before the rear end of the sheet 9 passes through the sheet supply roller 24 (t17). Therefore, the tray 1022 prevents overlap travelling of the sheets 9.

After this, when the sheet traveling sensor 33 detects that the rear end of the sheet 9 has passed on the sheet traveling sensor 33 (t18), the controller 32 stops the supply of electricity to the carrying electromagnetic clutch 35 after a predetermined length of time and stops the carrying motor 31 (t19). Thereby, the tray 1022 completes the sheet supply operation for the first sheet.

If the number of sheets designated by the sheet supply command is 2 or more, the controller 32 repeats the same operation until the supplied sheets 9 reach the designated number of sheets. When the sheet travelling sensor 33 detects that the rear end of the last sheet 9 has passed on the sheet travelling sensor 33, the controller 32 stops the supply of electricity to the carrying electromagnetic clutch 35 after a predetermined length of time and stops the carrying motor 31. Thereby, the tray 1022 completes the first operation.

(Second Operation, or Carrying Operation of Sheet Supplied from Another Tray)

First, the second operation (carrying operation of sheet supplied from another tray) of the tray 1022 is explained.

When the controller 32 of the tray 1022 receives a carrying command from the image recording device 21, the controller 32 rotates the carrying motor 31 in the positive rotational direction (counterclockwise direction shown in FIG. 11) at a predetermined rotational speed (t21).

After that, the sheet 9 supplied from another tray passes through the sheet carrying path 27 formed in the sheet cassette 23 and is guided toward the carrying roller 25 through the carrying path formed by the sheet guide (not shown).

When the sheet travelling sensor 33 detects a front end of the sheet 9, the controller 32 immediately starts the supply of electricity to the carrying electromagnetic clutch 35 and turns in a state to rotate the carrying roller 25 in accordance with the rotation of the coupling gear 45. As a result, the tray 1022 turns in a state to transmit a drive force from the carrying motor 31 to the carrying roller 25. Thereby, the carrying roller 25 rotates.

Then, when the sheet 9 supplied from another tray advances between the carrying roller 25 and the registration roller 28, the tray 1022 carries the sheet 9 toward the subsequent mechanisms using the carrying roller 25.

After this, when the sheet traveling sensor 33 detects that the number of sheets 9 designated by the carrying command have passed on the sheet traveling sensor 33 (t23), the controller 32 stops the supply of electricity to the carrying electromagnetic clutch 35 after a predetermined length of time and stops the carrying motor 31 (t24). Thereby, the tray 1022 completes the second operation.

(Operation of Sheet Supply Device According to First Embodiment)

Figure 5A:
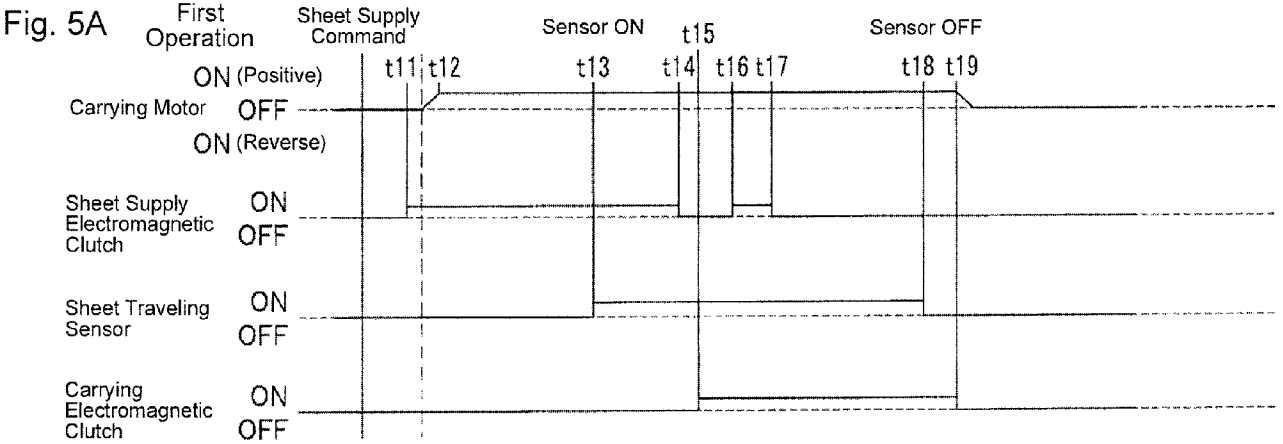
FIGS. 5A and 5B are time charts illustrating operations of the sheet supply device according to the first embodiment.
Figure 5B:
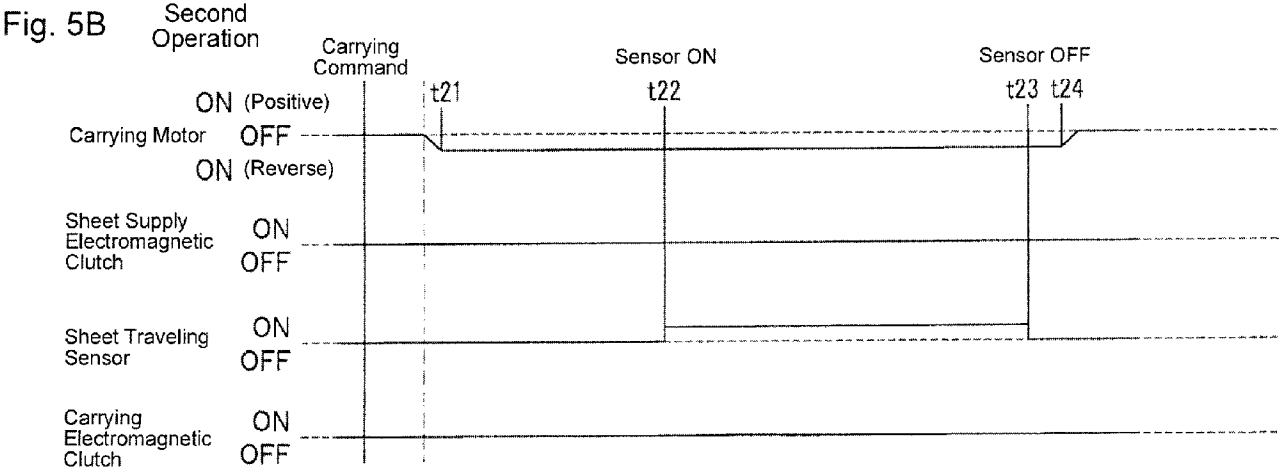

The operation of the tray 22 is explained below with reference to FIGS. 3A, 3B, 5A and 5B. FIGS. 5A and 5B are time charts illustrating operations of the sheet supply device according to the first embodiment.

(First Operation, or Sheet Supply Operation)

First, the first operation (sheet supply operation) of the tray 22 is explained.

When the controller 32 (see FIG. 2) of the tray 22 receives a sheet supply command from the image recording device 21, the controller 32 starts the supply of electricity to the sheet supply electromagnetic clutch 34 (t11) and turns in a state to rotate the sheet supply roller 24 in accordance with the rotation of the coupling gear 43. As a result, the tray 22 turns in a state to transmit a drive force from the carrying motor 31 to the sheet supply roller 24. After that, the controller 32 rotates the carrying motor 31 in the positive rotational direction (counterclockwise direction shown in FIG. 3A) at a predetermined rotational speed (t12). As a result, the tray 22 transmits a drive force from the carrying motor 31 to the sheet supply roller 24 via the gears 41 to 43 and rotates the sheet supply roller 24. Thereby, the tray 22 starts the sheet supply operation (i.e., operation to feed the sheets 9 stored in the internal sheet cassette 23 piece by piece to subsequent mechanisms).

At this time, as the bracket 12 rotates by certain angles in the positive rotational direction (counterclockwise direction shown in FIG. 3A) in accordance of the coupling gear 43, the planetary gear 46 is arranged at a position shown in FIG. 3A. As a result, the planetary gear 46 turns in a state to transmit the drive force from the carrying motor 31 to the carrying roller 25 via the coupling gear 45. Thereby, when electricity is supplied to the carrying electromagnetic clutch 35, as the drive force is transmitted from the carrying motor 31, the carrying roller 25 rotates.

The sheet 9 supplied from the internal sheet cassette 23 is guided to the carrying roller 25 through the carrying path formed by the sheet guide (not shown).

When a front end of the sheet 9 is detected by the sheet traveling sensor 33 (see FIG. 2) (t13), the controller 32 calculates a set amount in which a predetermined amount is added to a movement amount of the front end of the sheet 9 to reach the carrying roller 25, and temporality stops the supply of electricity to the sheet supply electromagnetic clutch 34 after carrying the sheet 9 by the set amount (t14). As a result, the tray 22 stops the carrying of the sheet 9 and aligns the sheet 9 by pressing the front end of the sheet 9 against the carrying roller 25.

After a predetermined length of time, the controller 32 starts the supply of electricity to the carrying electromagnetic clutch (t15) and turns in a state to rotate the carrying roller 25 in accordance with the rotation of the coupling gear 45. As a result, the tray 22 turns in a state to transmit a drive force from the carrying motor 31 to the carrying roller 25. Thereby, the carrying roller 25 rotates.

Next, the controller 32 resumes the supply of electricity to the sheet supply electromagnetic clutch 34. As a result, the sheet 9 advances between the carrying roller 25 and the registration roller 28. Thereby, the tray 22 carries the sheet 9 to the subsequent mechanisms using the carrying roller 25.

The controller 32 stops the supply of electricity to the sheet supply electromagnetic clutch 34 before the rear end of the sheet 9 passes through the sheet supply roller 24 (t17). Therefore, the tray 22 prevents overlap travelling of the sheets 9.

After this, when the sheet traveling sensor 33 detects that the rear end of the sheet 9 has passed on the sheet traveling sensor 33 (t18), the controller 32 stops the supply of electricity to the carrying electromagnetic clutch 35 after a predetermined length of time and stops the carrying motor 31 (t19). Thereby, the tray 22 completes the sheet supply operation for the first sheet.

If the number of sheets designated by the sheet supply command is 2 or more, the controller 32 repeats the same operation until the supplied sheets 9 reach the designated number of sheets. When the sheet travelling sensor 33 detects that the rear end of the last sheet 9 has passed on the sheet travelling sensor 33, the controller 32 stops the supply of electricity to the carrying electromagnetic clutch 35 after a predetermined length of time and stops the carrying motor 31. Thereby, the tray 22 completes the sheet supply operation.

(Second Operation, or Carrying Operation of Sheet Supplied from Another Tray)

Next, the second operation (carrying operation of sheet 9 supplied from another tray) of the tray 22 is explained.

When the controller 32 of the tray 22 receives a carrying command from the image recording device 21, the controller 32 rotates the carrying motor 31 in the reverse rotational direction (clockwise direction shown in FIG. 3B) at a predetermined rotational speed (t21).

At this time, as the bracket 12 rotates by certain angles in the reverse rotational direction (clockwise direction shown in FIG. 3B) in accordance of the coupling gear 43, the planetary gear 46 is arranged at a position shown in FIG. 3B. As a result, the planetary gear 46 turns in a state to transmit a drive force from the carrying motor 31 to the drive gear 48 via the idle gear 47. The drive gear 48 is fixed to a support shaft of the carrying roller 25. Thereby, when the drive force is transmitted from the carrying motor 31, the drive gear 48 transmits the drive force to the carrying roller 25 via the support shaft. As a result, the carrying roller 25 rotates.

After that, the sheet 9 supplied from another tray passes through the sheet carrying path 27 (see FIG. 2) formed in the sheet cassette 23 and is guided toward the carrying roller 25 through the carrying path formed by the sheet guide (not shown).

After the front end of the sheet 9 supplied from another tray is detected by the sheet travelling sensor 33 (t22), when the sheet 9 supplied from another tray advances between the carrying roller 25 and the registration roller 28, the tray 22 carries the sheet 9 toward the subsequent mechanisms using the carrying roller 25.

After this, when the sheet traveling sensor 33 detects that the number of sheet 9 designated by the carrying command have passed on the sheet traveling sensor 33 (t23), the controller 32 stops the carrying motor 31 (t24). Thereby, the tray 22 completes the second operation.

<Reducing Electricity Consumption>

Figure 6:
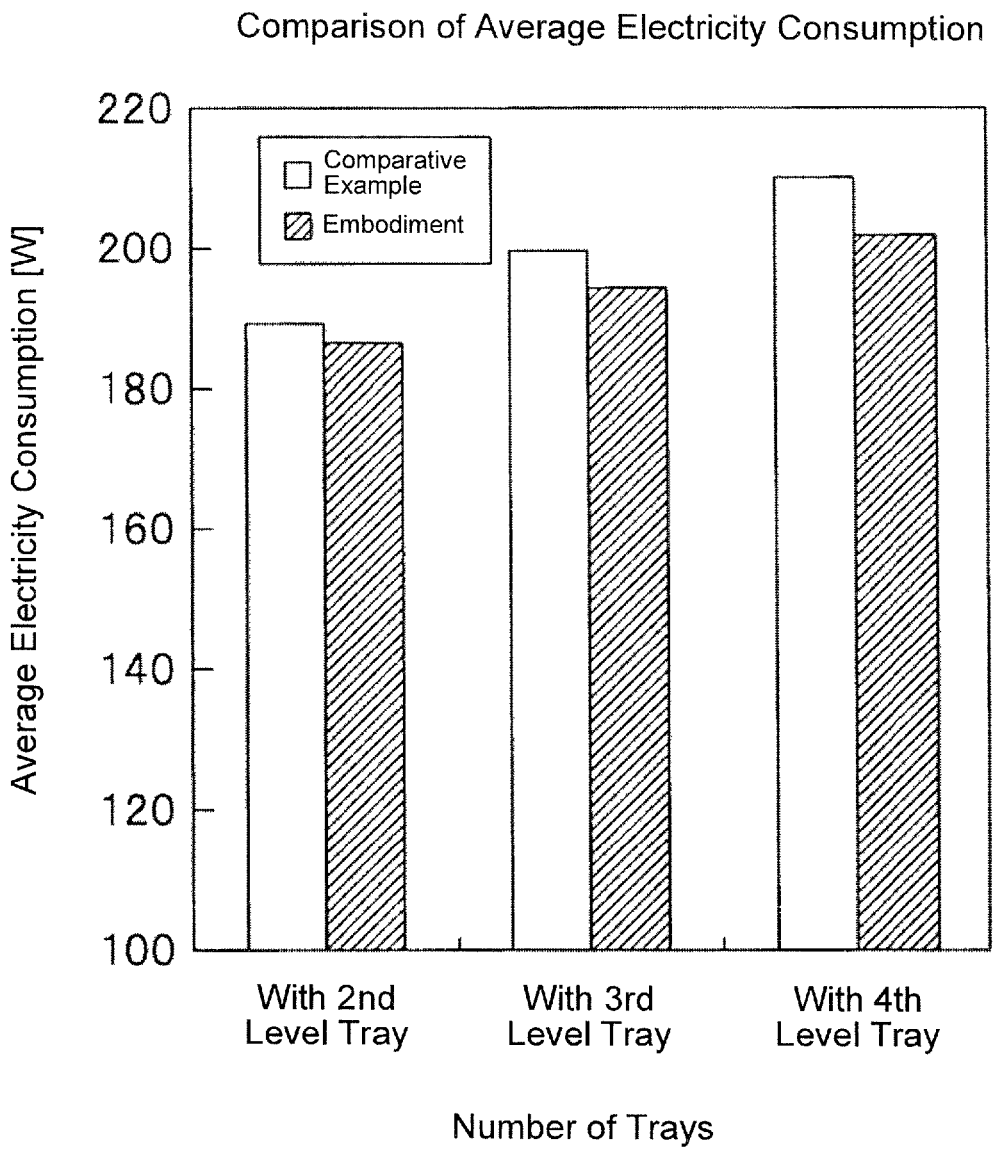
FIG. 6 is a first comparative diagram of electricity consumption of a comparative example and electricity consumption of the first embodiment.

The multi-level trays 22 do not operate the carrying electromagnetic clutch 35 during the second operation. Therefore, electricity consumption of the multi-level trays 22 for operating the carrying electromagnetic clutch 35 is reduced during the second operation. The effects on reducing electricity consumption of the multi-level trays 22 are explained below with reference to FIGS. 6 and 7. FIGS. 6 and 7 are second comparative diagrams of electricity consumption of the comparative example and electricity consumption of the first embodiment. FIG. 6 indicates a number of trays installed in the main body (image recording device 21) along the horizontal axis and average entire electricity consumption (W) of the main body and multi-level trays. In addition, FIG. 6 shows average electricity consumption at the time when the image recording device 21, to which the multi-level trays 1022 shown in FIGS. 11 and 12 are installed, performs printing at a print speed of 30 page per minute (PPM) as a comparative example, and an average electricity consumption at the time when the image recording device 21, to which the multi-level trays 22 shown in FIGS. 3A, 3B and 4 are installed, performs printing at a print speed of 30 PPM as the embodiment. In addition, FIGS. 7A and 7B show details of the average electricity consumption shown in FIG. 6.

With the comparative example, the average electricity consumption of the main body (image recording device 21) and the sheet supply devices (multi-level trays 1022) together is 189.5 W when the second level tray is installed, 199.9 W when the third level tray is installed and 210.3 W when the fourth level tray is installed. On the other hand, with the embodiment, the average electricity consumption of the main body (image recording device 21) and the sheet supply devices (multi-level trays 22) together is 186.6 W when the second level tray is installed, 194.1 W when the third level tray is installed and 201.6 W when the fourth level tray is installed.

Therefore, with the embodiment, the electricity consumption is reduced by 1.5% when the second level tray is installed, 3.0% when the third level tray is installed, and 4.3% when the fourth level tray is installed. This tendency becomes more noticeable when the number of trays installed increases.

As described above, according to the sheet supply devices (multi-level trays 22) according to the first embodiment, when a plurality of the sheet supply devices are installed in the image recording device 21, and when there is a sheet supply device that performs only the second operation (operation to carry a sheet 9 supplied from another sheet supply device), the sheet supply device that performs only the second operation rotates the carrying roller 25 without receiving a supply of electricity from the image recording device 21 for carrying the sheet 9 (i.e., without operating the carrying electromagnetic clutch 35). Therefore, according to the multi-level trays 22, when a plurality of sheet supply devices are installed in the image recording device 21 and when there is a sheet supply device that performs only the second operation, the supply of electricity to the carrying electromagnetic clutch 35 of the sheet supply device that performs only the second operation is eliminated. Therefore, the entire electricity consumption is reduced compared with the sheet supply devices (multi-level trays 1022) as the comparative example.

In addition, because the multi-level trays decrease the entire electricity consumption, a small capacity power source unit can be used in the image recording device 21. Accordingly, with the multi-level trays 22, increase in the size of the power source unit built in the image recording device 21 can be suppressed, thereby promoting miniaturization and reduction of cost of the image recording device 21.

Second Embodiment

Configuration of Sheet Supply Device

Compared with the multi-level trays 22 that are the sheet supply devices according to the first embodiment, multi-level trays 122 that are the sheet supply devices according to the second embodiment are different in the configuration of the drive mechanism that drives the sheet supply roller 24 and the carrying roller 25. Other configurations are the same.

(Configuration of Drive Mechanism for Sheet Supply Device)

Figure 8A:
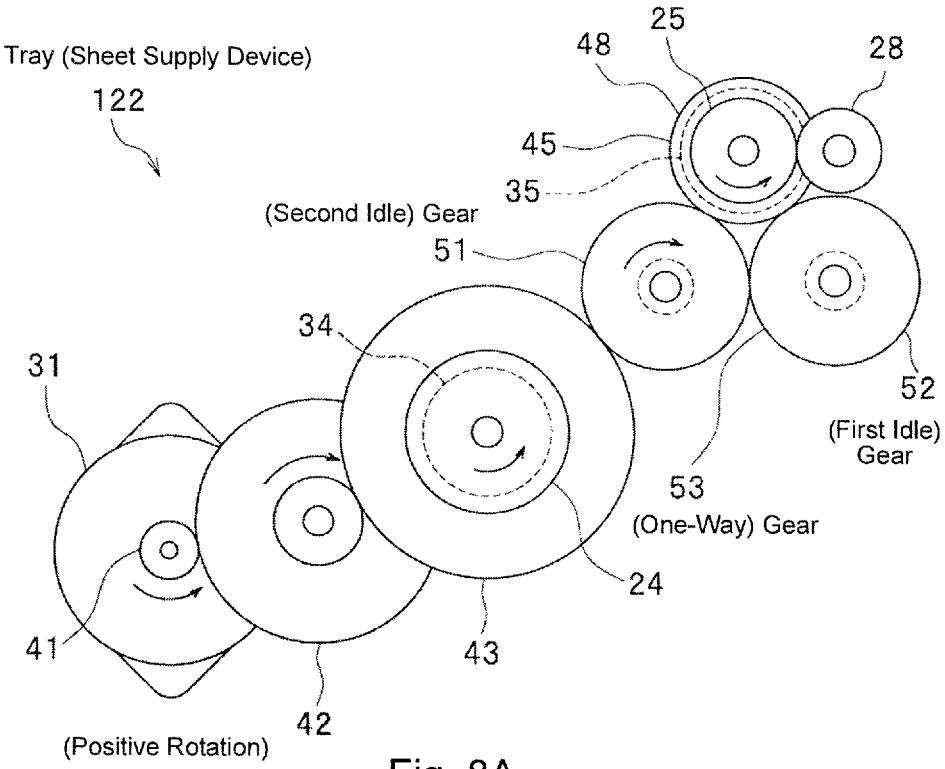
FIGS. 8A and 8B are first schematic diagrams illustrating a configuration of a drive mechanism for the sheet supply device according to a second embodiment.
Figure 8B:
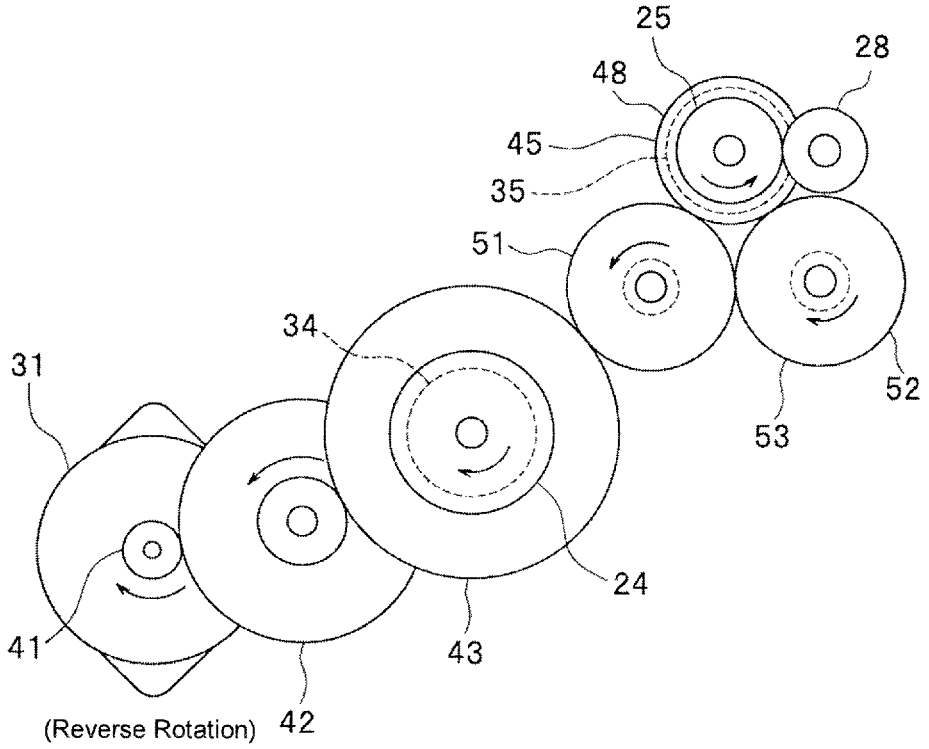
Figure 9:
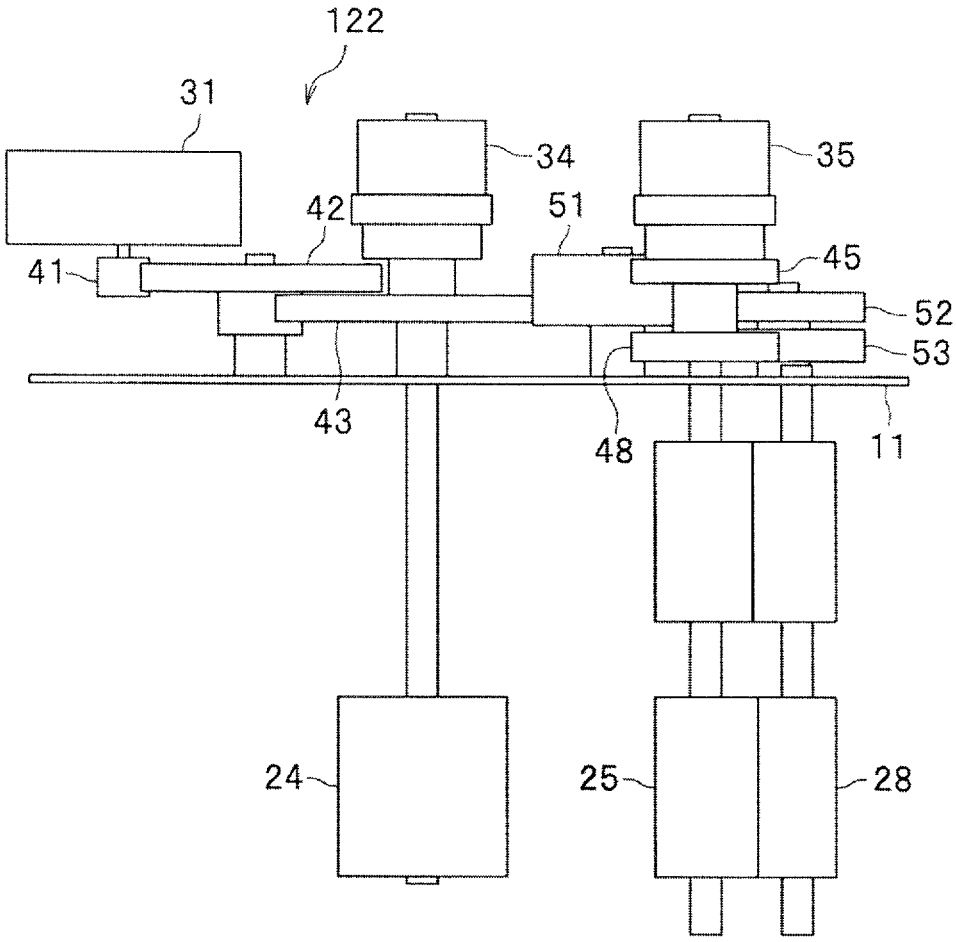
FIG. 9 is a second schematic diagram illustrating the configuration of the drive mechanism for the sheet supply device according to the second embodiment.
Figure 10:
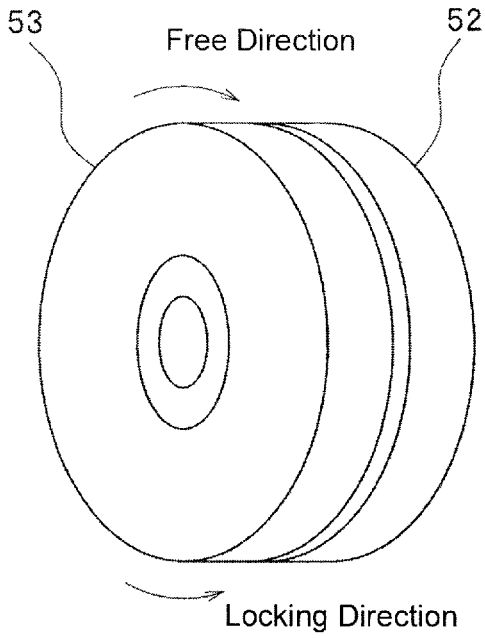
FIG. 10 is a third schematic diagram illustrating the configuration of the drive mechanism for the sheet supply device according to the second embodiment.

The configuration of the sheet supply device according to the second embodiment is explained below with reference to FIGS. 8A to 10. Each of FIGS. 8A to 10 is a schematic diagram illustrating the configuration of the drive mechanism for the sheet supply device according to the second embodiment. FIGS. 8A and 8B are side views of the configuration of the drive mechanism for the tray 122 as the sheet supply device according to the second embodiment. FIG. 8A illustrates a state of the drive mechanism for the tray 122 when the first operation (sheet supply operation) is performed, and FIG. 8B illustrates a state of the drive mechanism for the tray 122 when the second operation (carrying operation of a sheet 9 supplied from another tray) is performed. FIG. 9 is a top view of the configuration of the drive mechanism for the tray 122. In addition, FIG. 10 illustrates a configuration of one-way mechanism that configures a part of the drive mechanism.

Comparing with the sheet supply device (tray 22) according to the first embodiment, the tray 122 has a configuration in which the bracket 12, the planetary gear 46 and the idle gear 47 shown in FIGS. 3A, 3B and 4 are removed, and instead, a first idle gear 52, a second idle gear 51 and a one-way gear 53 are included.

The first gear 52 (hereinafter may be called simply "idle gear 52") is a gear that engages with the second idle gear 51. The first idle gear 52 is attached freely rotatably to a stud as a supporting point that is fixed to the frame 11 by caulking or the like. The first idle gear 52 rotates in accordance with the rotation of the second idle gear 51.

The second gear 51 (hereinafter may be called simply "idle gear 51") is a gear that engages with the coupling gear 43, the coupling gear 45 and the first idle gear 52. The second idle gear 51 is attached freely rotatably to a stud as a support point that is fixed to the frame 11 (see FIG. 9) by caulking or the like. The second idle gear 51 rotates in accordance with the rotation of the coupling gear 43 and functions as a deceleration gear. The second idle gear 51 transmits a drive force from the carrying motor 31 to both the coupling gear 45 and the first idle gear 52.

The one-way gear 53 is a gear that engages with the drive gear 48. Together with the first idle gear 52, the one-way gear 53 configures a one-way mechanism shown in FIG. 10 and rotates only in one direction. That is, as shown in FIG. 10, the one-way gear 53 is attached to a boss of the first idle gear 52 fixed freely rotatably to the frame 11 (see FIG. 9) so as to rotate only in one direction. Therefore, the one-way gear 53 idles when the rotation of the first idle gear 52 is in a free direction. On the other hand, the one-way gear 53 rotates in accordance with the rotation of the first idle gear 52 when the first idle gear 52 rotates in a locking direction.

For example, in the example shown in FIG. 8A, because the second idle gear 51 rotates in the reverse rotational direction (clockwise direction in FIG. 8A), the first idle gear 52 rotates in the positive rotational direction (counterclockwise direction in FIG. 8A). In this case, the one-way gear idles as the rotation of the first idle gear 52 is the rotation in the free-direction. Therefore, the one-way gear 53 does not transmit the drive force to the drive gear 48. In the mean time, in the example shown in FIG. 8B, because the second idle gear 51 rotates in the positive rotational direction (counterclockwise direction in FIG. 8B), the first idle gear 52 rotates in the reverse rotational direction (clockwise direction in FIG. 8B). In this case, the one-way gear 53 rotates in accordance with the rotation of the first idle gear 52 because the rotation of the first idle gear 52 is the rotation in the locking direction. Therefore, the one-way gear 53 transmits the drive force to the drive gear 48.

When the tray 122 rotates the carrying roller 25 in the first operation (sheet supply operation), the tray 122 rotates the carrying motor 31 in the positive rotational direction (counterclockwise direction shown in FIG. 8A). As a result, the drive force from the carrying motor 31 is transmitted to the carrying roller 25 via the gears 41 to 43, the second idle gear 51, the coupling gear 45 and the carrying electromagnetic clutch 35, and thereby the carrying roller 25 is rotated. In this case, the tray 122 transmits a drive force from the carrying motor 31 to the first idle gear 52 via the second idle gear 51 and rotates the first idle gear 52. However, because the rotation of the first idle gear 52 causes the one gear 53 to rotate in the free direction, the one-way gear 53 does not rotate. Therefore, the one-way gear 53 does not inhibit the rotation of the carrying roller 25.

In the meantime, when the tray 122 rotates the carrying roller 25 in the second operation (carrying operation of a sheet 9 supplied from another tray), the tray 122 rotates the carrying motor 31 in the reverse rotational direction (clockwise direction shown in FIG. 3B). As a result, the drive force from the carrying motor 31 is transmitted to the carrying roller 25 via the gears 41 to 43, the idle gears 51 and 52, the one-way gear 53 and the drive gear 48, and thereby the carrying roller 25 is rotated.

Therefore, by selectively switching the rotational direction of the carrying motor 31, the tray 122 switches a route for transmitting the drive force between the carrying motor 31 and the carrying roller 25.

<Operation of Sheet Supply Device>

The tray 122 is explained below with reference to FIGS. 8A, 8B, 5A and 5B. As shown in FIGS. 5A and 5B, the tray 122 performs the control described below to the carrying motor 31, the sheet supply electromagnetic clutch 34 and the carrying electromagnetic clutch 35 at the timing similar to the tray 22 according to the first embodiment.

(First Operation, or Sheet Supply Operation)

First, the first operation (sheet supply operation) of the tray 122 is explained.

When the controller 32 (see FIG. 2) of the tray 122 receives a sheet supply command from the image recording device 21, the controller 32 starts the supply of electricity (or electric power) to the sheet supply electromagnetic clutch 34 (t11) and turns in a state to rotate the sheet supply roller 24 in accordance with the rotation of the coupling gear 43. As a result, the tray 122 turns in a state to transmit a drive force from the carrying motor 31 to the sheet supply roller 24. After that, the controller 32 rotates the carrying motor 31 in the positive rotational direction (counterclockwise direction shown in FIG. 8A) at a predetermined rotational speed (t12). As a result, the tray 122 transmits a drive force from the carrying motor 31 to the sheet supply roller 24 via the gears 41 to 43 and rotates the sheet supply roller 24. Thereby, the tray 122 starts the sheet supply operation (i.e., operation to feed the sheets 9 stored in the internal sheet cassette 23 piece by piece to subsequent mechanisms).

At this time, the second idle gear 51 transmits a drive force to the coupling gear 45, the first idle gear 52 and the one-way gear 53. However, the one-way gear 53 idles because the rotation of the one-way gear 53 is in the free direction. Therefore, the one-way gear 53 does not transmit the drive force to the drive gear 48.

The sheet 9 supplied from the internal sheet cassette 23 is guided to the carrying roller 25 through the carrying path formed by the sheet guide (not shown).

When a front end of the sheet 9 is detected by the sheet traveling sensor 33 (t13), the controller 32 calculates a set amount in which a predetermined amount is added to a movement amount of the front end of the sheet 9 to reach the carrying roller 25, and temporality stops the supply of electricity to the sheet supply electromagnetic clutch 34 after carrying the sheet 9 by the set amount (t14). As a result, the tray 122 stops the carrying of the sheet 9 and aligns the sheet 9 by pressing the front end of the sheet 9 against the carrying roller 25.

After a predetermined length of time, the controller 32 starts the supply of electricity to the carrying electromagnetic clutch (t15) and turns in a state to rotate the carrying roller 25 in accordance with the rotation of the coupling gear 45. As a result, the tray 122 turns in a state to transmit a drive force from the carrying motor 31 to the carrying roller 25. Thereby, the carrying roller 25 rotates.

Next, the controller 32 resumes the supply of electricity to the sheet supply electromagnetic clutch 34. As a result, the sheet 9 advances between the carrying roller 25 and the registration roller 28. Thereby, the tray 122 carries the sheet 9 to the subsequent mechanisms using the carrying roller 25.

The controller 32 stops the supply of electricity to the sheet supply electromagnetic clutch 34 before the rear end of the sheet 9 passes through the sheet supply roller 24 (t17). Therefore, the tray 122 prevents overlap travelling of the sheets 9.

After this, when the sheet traveling sensor 33 detects that the rear end of the sheet 9 has passed on the sheet traveling sensor 33 (see FIG. 2) (t18), the controller 32 stops the supply of electricity to the carrying electromagnetic clutch 35 after a predetermined length of time and stops the carrying motor 31 (t19). Thereby, the tray 122 completes the sheet supply operation for the first sheet.

If the number of sheets designated by the sheet supply command is 2 or more, the controller 32 repeats the same operation until the supplied sheets 9 reach the designated number of sheets. When the sheet travelling sensor 33 detects that the rear end of the last sheet 9 has passed on the sheet travelling sensor 33, the controller 32 stops the supply of electricity to the carrying electromagnetic clutch 35 after a predetermined length of time and stops the carrying motor 31. Thereby, the tray 122 completes the first operation.

(Second Operation, or Carrying Operation of Sheet Supplied from Another Tray)

Next, the second operation (carrying operation of sheet 9 supplied from another tray) of the tray 122 is explained.

When the controller 32 of the tray 122 receives a carrying command from the image recording device 21, the controller 32 rotates the carrying motor 31 in the reverse rotational direction (clockwise direction shown in FIG. 8B) at a predetermined rotational speed (t21).

At this time, the second idle gear 51 transmits a drive force to the coupling gear 45, the first idle gear 52 and the one-way gear 53. The one-way gear 53 rotates because the rotation of the one-way gear 53 is in the locking direction. As a result, the one-way gear 53 transmits the drive force to the drive gear 48. Therefore, the drive gear 48 rotates.

The drive gear 48 is fixed to a support shaft of the carrying roller 25. Thereby, the drive gear 48 transmits the drive force to the carrying roller 25 via the support shaft. At this time, the coupling gear 45 receives the drive force from the second idle gear 51 that is in an opposite direction from the rotational direction of the carrying roller 25. However, unless electricity is supplied to the carrying electromagnetic clutch 35, the drive force is not transmitted to the carrying roller 25. Therefore, the coupling gear 45 does not prevent the rotation of the carrying roller 25.

After that, the sheet 9 supplied from another tray passes through the sheet carrying path 27 (see FIG. 2) formed in the sheet cassette 23 and is guided toward the carrying roller 25 through the carrying path formed by the sheet guide (not shown).

After the front end of the sheet 9 supplied from another tray is detected by the sheet travelling sensor 33 (t22), when the sheet 9 supplied from another tray advances between the carrying roller 25 and the registration roller 28, the tray 122 carries the sheet 9 toward the subsequent mechanisms using the carrying roller 25.

After this, when the sheet traveling sensor 33 detects that the number of sheet 9 designated by the carrying command have passed on the sheet traveling sensor 33 (t23), the controller 32 stops the carrying motor 31 (t24). Thereby, the tray 122 completes the second operation.

The electricity consumption of the multi-level trays 122 becomes similar to that of the multi-layer trays 22 according to the first embodiment. Therefore, similar to the multi-level trays 22 according to the first embodiment, the multi-level trays 122 reduce the entire electricity consumption compared with the sheet supply device (multi-level trays 1022) as the comparative example.

As described above, according to the sheet supply devices (multi-level trays 122) according to the second embodiment, effects similar to those of the multi-level trays 22 (i.e., effects that the entire electricity consumption is reduced from the fact that, when a plurality of sheet supply devices are installed in the image recording device 21 and when there is a sheet supply device that performs only the second operation, the supply of electricity to the carrying electromagnetic clutch 35 of the sheet supply device that performs only the second operation is eliminated) are obtained.

The present embodiments are not limited to those described above, and various changes and modifications are available without departing from the scope of the invention. For example, the embodiments are not limited to be used in an image recording device, such as a printer, a photocopy machine, a facsimile machine and an MFP but may be adapted in sheet supply devices that can be installed in a medium processing device other than the image recording device.

What is claimed is:

1. A sheet supply device that is addable to a medium processing device and that is configured to supply media to the medium processing device, the sheet supply device comprising:

a storage part that stores a first medium;

a sheet supply part that supplies the first medium from the storage part;

a sheet carrying path through which a second medium is carried from an upstream side of a medium path;

a carrying part that carries the first medium and the second medium to a downstream side of the medium path;

a drive source that provides a drive force to each of the sheet supply part and the carrying part;

a carrying transmission member that selectively transmits the drive force to the carrying part;

a transmission mechanism that transmits the drive force to the carrying part without transmitting the drive force via the carrying transmission member; and a controller that operates the drive source and the carrying transmission member, wherein the controller performs a first operation in which the first medium is supplied from the storage part of the sheet supply device, and a second operation in which the second medium supplied from the upstream side is carried to the downstream side, and when the second operation is performed, the controller operates the carrying part by transmitting the drive force to the carrying part via the transmission mechanism without operating the carrying transmission member.

2. The sheet supply device according to claim 1, further comprising:

a sheet supply transmission member that selectively transmits the drive force to the sheet supply part.

3. The sheet supply device according to claim 2, wherein when the first operation is performed, the controller operates the sheet supply part by operating the sheet supply transmission member and operates the carrying part by operating the carrying transmission member.

4. The sheet supply device according to claim 2, wherein the sheet supply part, the carrying part, the drive source, the sheet supply transmission member and the carrying transmission member are configured from a sheet supply roller, a carrying roller, a motor, a sheet supply clutch and a carrying clutch, respectively.

5. The sheet supply device according to claim 4, wherein the sheet supply clutch is configured from an electromagnetic clutch provided on a support shaft that supports the sheet supply roller, the carrying clutch is configured from another electromagnetic clutch provided on a support shaft that supports the carrying roller, and the sheet supply clutch and the carrying clutch are respectively operated by electricity supplied from an external source.

6. The sheet supply device according to claim 4, wherein the transmission mechanism includes:

a drive gear provided coaxially with the carrying roller;

an idle gear that engages with the drive gear; and a planetary gear that selectively engages with one of the idle gear and a coupling gear that is provide coaxially with the carrying roller that transmits the drive force to the carrying roller via the carrying clutch, depending on a position of the planetary gear.

7. The sheet supply device according to claim 6, wherein when the first operation is performed, the controller rotates the carrying roller via the coupling gear and the carrying clutch by rotating the motor, in a state where the planetary gear is engaged with the coupling gear and where the carrying clutch is operated, and when the second operation is performed, the controller rotates the carrying roller via the idle gear and the drive gear by rotating the motor in a direction opposite from the rotation during the first operation, in a state where the planetary gear is engaged with the idle gear and where the carrying clutch is not operated.

8. The sheet supply device according to claim 4, wherein the transmission mechanism includes:

a drive gear provided coaxially with the carrying roller;

a first idle gear;

a one-way gear that is provided coaxially with the first idle gear so as to engage with the drive gear, that idles when the first idle gear rotates in a free direction, and that transmits the drive force transmitted via the first idle gear to the drive gear when the first idle gear rotates in a locking direction; and a second idle gear that is provide coaxially with the carrying roller and that engages with both the first idle gear and the coupling gear that is provided coaxially with the carrying roller and transmits the drive force to the carrying roller via the carrying clutch.

9. The sheet supply device according to claim 8, wherein when the first operation is performed, the controller rotates the carrying roller via the coupling gear and the carrying clutch by rotating the motor in a direction by which the one-way gear is turned to a free state, while operating the carrying clutch, and when the second operation is performed, the controller rotates the carrying roller via the first idle gear and the drive gear by rotating the motor in a direction opposite from the first operation by which the one-way gear is turned to a locked state, without operating the carrying clutch.

10. A medium processing device, comprising:

an image forming unit that forms an image with developer;

a fusion unit that fuse the image by the image forming unit;

the sheet supply device of claim and a duplicate of the sheet supply device that are arranged on the upstream side from the image forming unit, one being a first sheet supply device on the upstream side and the other being a second sheet supply device on the downstream side, each of the first and second sheet supply devices having an inlet and outlet; and a sheet carrying path through which the first and second media are carried to the image forming unit, wherein the outlet of the first sheet supply device is connected to the inlet of the second sheet supply device so that the second medium supplied from the first sheet supply device is carried to the image forming unit through the second sheet supply device.

11. A sheet supply device, comprising:

a storage part that stores a medium;

a drive source that provides a drive force;

a sheet supply part that supplies the medium to a medium path from the storage part;

a carrying part that carries the medium to a downstream side of the medium path;

a carrying transmission member that transmits the drive force to the carrying part;

a transmission mechanism that transmits the drive force to the carrying part without transmitting the drive force via the carrying transmission member; and a controller that operates the drive source and the carrying transmission member, wherein the controller is configured to switch a first operation, in which the drive force is conveyed to the carrying part via the carrying transmission member, and a second operation, in which the drive force is conveyed to the carrying part via the transmission mechanism.

12. An image forming device, comprising:

the sheet supply device according to claim 11;

an image forming unit that forms an image with developer; and a fusion unit that fuse the image formed by the image forming unit on the medium supplied from the sheet supply device.

* * * * *